US012048957B2

(12) United States Patent
Sarver et al.

(10) Patent No.: US 12,048,957 B2
(45) Date of Patent: Jul. 30, 2024

(54) WIRE DRAWING MONITORING SYSTEM

(71) Applicant: PARAMOUNT DIE COMPANY, INC., Abingdon, MD (US)

(72) Inventors: Richard Sarver, Abingndon, MD (US); Karl N. Naumann, Abingdon, MD (US); Joao Norona, Abingdon, MD (US)

(73) Assignee: Paramount Die Company, Inc., Abingdon, MD (US)

( * ) Notice: Subject to any disclaimer, the term of this patent is extended or adjusted under 35 U.S.C. 154(b) by 140 days.

(21) Appl. No.: 17/432,081

(22) PCT Filed: Feb. 20, 2020

(86) PCT No.: PCT/US2020/019128
§ 371 (c)(1),
(2) Date: Aug. 18, 2021

(87) PCT Pub. No.: WO2020/172477
PCT Pub. Date: Aug. 27, 2020

(65) Prior Publication Data

US 2022/0184682 A1 Jun. 16, 2022

Related U.S. Application Data

(60) Provisional application No. 62/807,834, filed on Feb. 20, 2019.

(51) Int. Cl.
*B21C 3/14* (2006.01)
*B21C 51/00* (2006.01)

(52) U.S. Cl.
CPC ..... *B21C 51/00* (2013.01); *B21C 3/14* (2013.01)

(58) Field of Classification Search
CPC .... B21C 1/00; B21C 1/02; B21C 3/02; B21C 3/12; B21C 3/14; B21C 51/00; G01L 1/04
See application file for complete search history.

(56) References Cited

U.S. PATENT DOCUMENTS 3,740,990 A * 6/1973 Prajsnar ..... B21C 3/14 72/342.3
3,782,154 A 1/1974 Fuchs
(Continued)

FOREIGN PATENT DOCUMENTS

CN 102896465 A 1/2013
DE 4019865 A1 1/1992
(Continued)

OTHER PUBLICATIONS

Translation De 4019865A1, Beller et al. Jan. 1992.*
(Continued)

*Primary Examiner* — Edward T Tolan
(74) *Attorney, Agent, or Firm* — The Morales Law Firm; Joseph L. Morales

(57) ABSTRACT

A drawing die system that has least two probes to measure various characteristics of components of the die box or the wire being drawn through the die box. The system includes a smart die that in which the multiple probes send information to a data processing unit. The data processing unit takes the information from the various probes and controls the various parameters of the wire drawing process. One smart die has a probe that collects information directly from a drawing die holder. The smart die also includes a force sensor and is configured to allow a die box to be displaced along an axis that is parallel to the direction in which the wire is drawn. The data processing unit controls various wired drawing parameters such as wire drawing speed,
(Continued)

coolant pressure and the rate at which the coolant is pumped through the system.

25 Claims, 10 Drawing Sheets

(56) References Cited

U.S. PATENT DOCUMENTS

| | | | | |
|---|---|---|---|---|
| 3,973,426 | A | 8/1976 | Fujita et al. | |
| 4,054,044 | A * | 10/1977 | Wareing | C23C 14/562 29/DIG. 44 |
| 4,152,380 | A | 5/1979 | Graves et al. | |
| 4,196,607 | A | 4/1980 | Youtsey et al. | |
| 4,321,843 | A | 3/1982 | Schwab et al. | |
| 4,404,827 | A | 9/1983 | Sype | |
| 5,277,044 | A | 1/1994 | Samyn | |
| 6,220,749 | B1 | 4/2001 | Wyker | |
| 6,484,587 | B2 * | 11/2002 | Gul | G01L 19/0015 73/756 |
| 9,079,232 | B2 | 7/2015 | Corder | |
| 9,636,729 | B2 | 5/2017 | Lutterbach et al. | |
| 10,239,103 | B2 | 3/2019 | Sigloch et al. | |
| 2016/0199895 | A1 | 7/2016 | Aparicio | |
| 2016/0279689 | A1 | 9/2016 | Angelilli et al. | |
| 2017/0157658 | A1 | 6/2017 | Wu et al. | |

FOREIGN PATENT DOCUMENTS

| | | | |
|---|---|---|---|
| EP | 2991784 | A2 | 3/2016 |
| JP | S6037210 | A | 2/1985 |
| JP | H09138122 | A | 5/1997 |
| WO | 2015075660 | A2 | 5/2015 |

OTHER PUBLICATIONS

European Examination Report of Counterpart European Application dated Oct. 28, 2022.
Counterpart Examination Report from China 2020800295143.
Counterpart Examination Report from India 202127041945.
Counterpart Examination Report from Japan 2021-549439.

* cited by examiner

FIG 1A
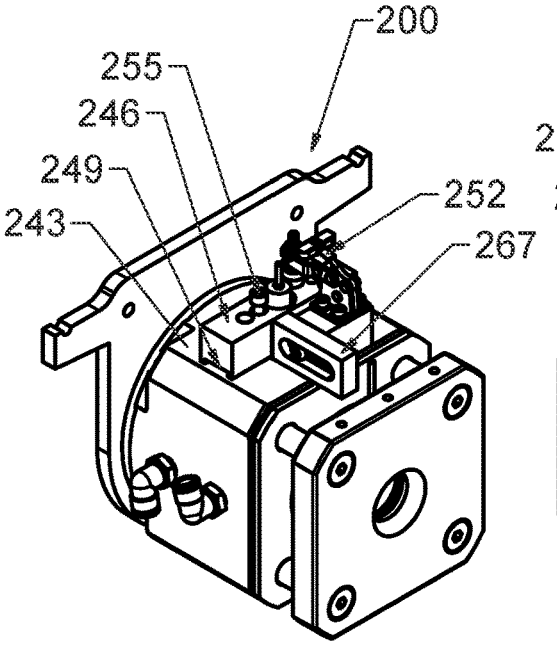
FIG 1B
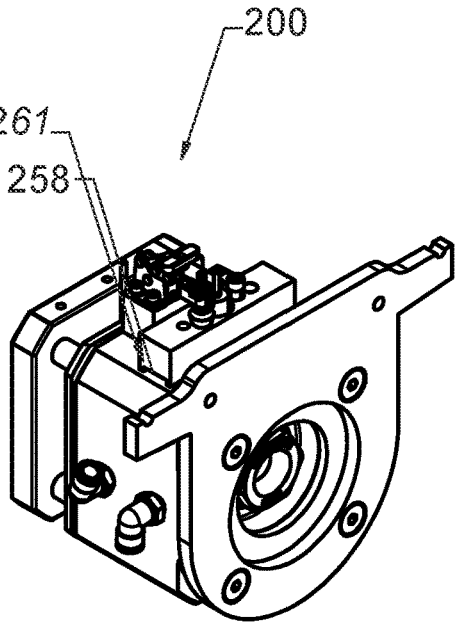
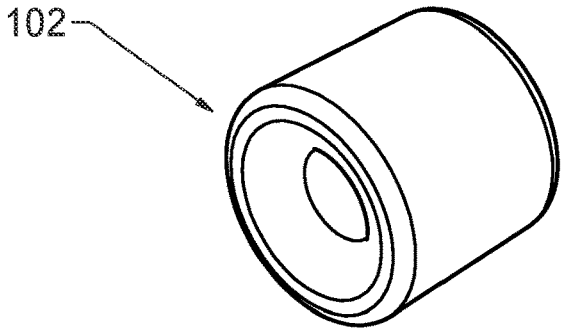
FIG 2C
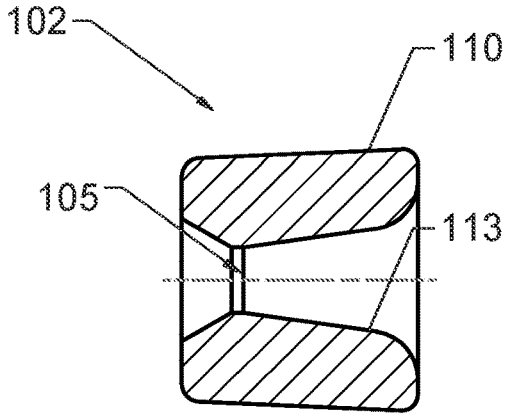
FIG 2A
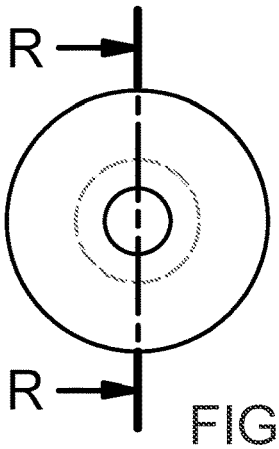
FIG 2B FIG 6A
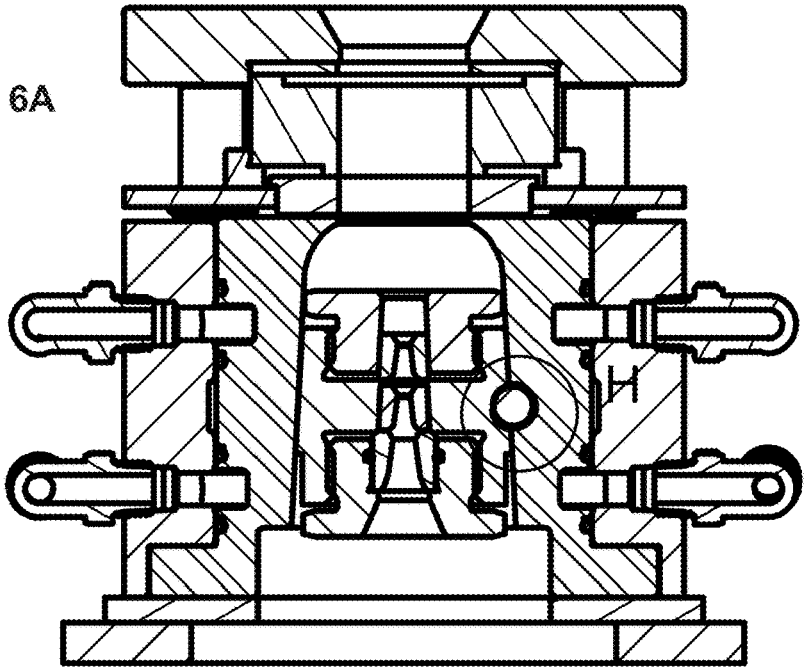
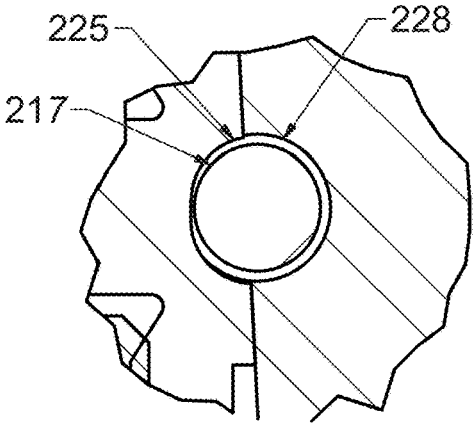
FIG 6B
FIG 6C
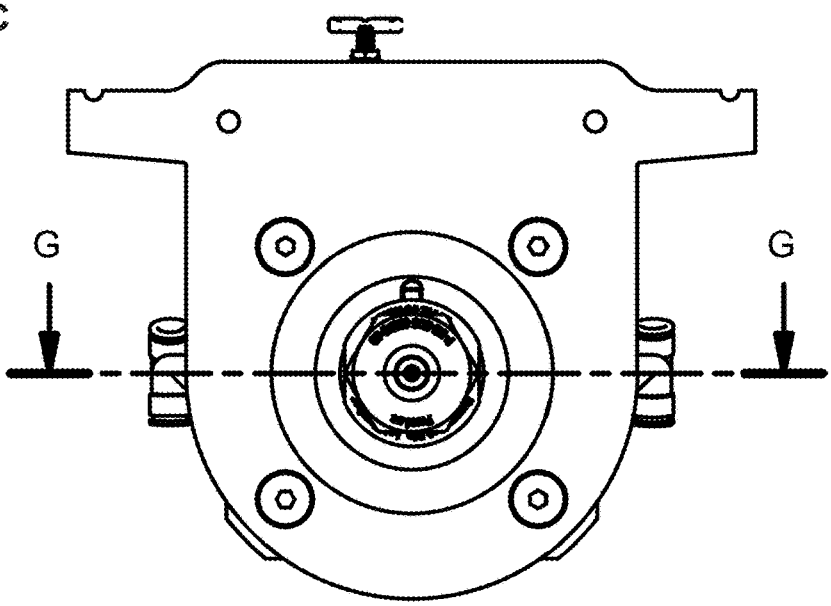

WIRE DRAWING MONITORING SYSTEM

BACKGROUND OF THE INVENTION

Field of the Invention

This invention relates to the field of manufacturing metal wires by drawing machines. More specifically to dies and die holders and monitoring systems for such manufacturing.

Background

Applications for wire have become more and more demanding from technical and commercial perspectives. This has required wire producers to increase production speeds and draw wire to ever tighter finished wire tolerances and specific mechanical properties with minimum downtime. Some examples are production of Ultra High Tensile carbon wire, super duplex stainless steels, titanium, Inconel, and many others.

In order to produce finished wire of a targeted diameter and mechanical properties, wire rod of different metal alloys is drawn through one or more wire-drawing dies used in specialized wire-drawing machinery to reduce its diameter or change its shape. In order to reach the required wire diameter and mechanical properties, the wire is cold-drawn in as few as 1 and as many as 27 or more consecutive steps.

In the current state of the industry, most wire drawing dies nibs are permanently encased in steel or other metallic cases which are discarded as soon as the carbide or diamond nib material has worn past its useful life. At that point, the cases and permanently cased nib are discarded and recycled. A wire drawing die nib is the core material in a wire drawing die that is made of tungsten carbide, polycrystalline diamond, natural or synthetic diamond amongst other hard materials. In certain applications, the die nibs are replaceable.

The wiring process results in significant stress upon the various components of the drawing system. Due to the significantly stress on the system, system components regularly fail before their expected usable life. It is very difficult to measure the system's physical characteristics. The prior art includes various probes and sensors that can be placed externally on the components of a wire drawing machine. However, there are no internal sensors that provide a clear picture of the status of the various components and that can be combined to control the various parameters of the wire drawing process.

SUMMARY OF THE INVENTION

This application is directed to wire drawing monitoring system and the components that facilitate control of the wire drawing process. One embodiment is a drawing die holder that includes a drawing channel, and a die probe channel that extends from an outer wall to an inner wall of the drawing die holder. Another embodiment is a die box having two or more probes that measure various characteristics of components of the die box or a wire being drawn through the die box. A further embodiment is a system that consists of a wire drawing monitoring system having a wire drawing box comprising two or more probes that measure two or more properties of a wire drawing device. The one of said two or more properties are measured at a die surface that is parallel to a die holder surface, and a control unit, wherein the two or more probes send information to the control unit.

Other and additional objects of this invention will become apparent from a consideration of this entire specification.

BRIEF DESCRIPTION OF THE DRAWINGS

The above and other features, aspects, and advantages of the present invention are considered in more detail, in relation to the following description of embodiments thereof shown in the accompanying drawings, in which:

FIG. 1A is a perspective front view of a die box.

FIG. 1B is a perspective rear view of a die box.

FIG. 2A is a perspective view of a die.

FIG. 2B is a cross-section along the RR axis of the die.

FIG. 2C is a bottom view of a die.

FIG. 6A is a cross-section along axis GG

FIG. 6B is an expanded view of square H of FIG. 6A.

FIG. 6C is a rear view of the die box.

DETAILED DESCRIPTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the invention, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

This application describes a wire drawing monitoring system that collects various characteristics of the components a wire drawing machine or multiple wire drawing machines to improve the wire drawing machine's efficiency, reduce downtime due to component failure, and reduce costs. In some embodiments, the wire drawing monitoring system includes a Smart Die System component, as described herein. The system collects information from one or more probes that measure physical characteristics of the components of the wire drawing machine, such as the various dies used in the process, die holders, die boxes and the wire itself. As described herein, the term "probe" means any type of device that collects information to be used by the system, whether it is a physical probe or any type of sensor.

In some embodiments, the system collects information from two or more probes that measure physical characteristics of the components of the wire drawing machine. In some embodiments, the monitoring system includes a die box 200 as shown in FIGS. 1A and 1B.

Figure 3A:
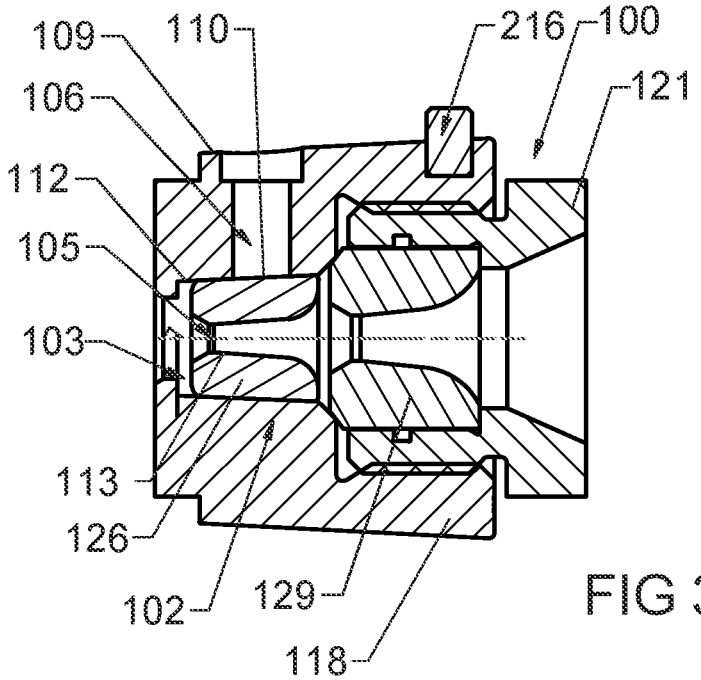
FIG. 3A is a cross-sectional view of a die holder having a two piece die.
Figure 3B:
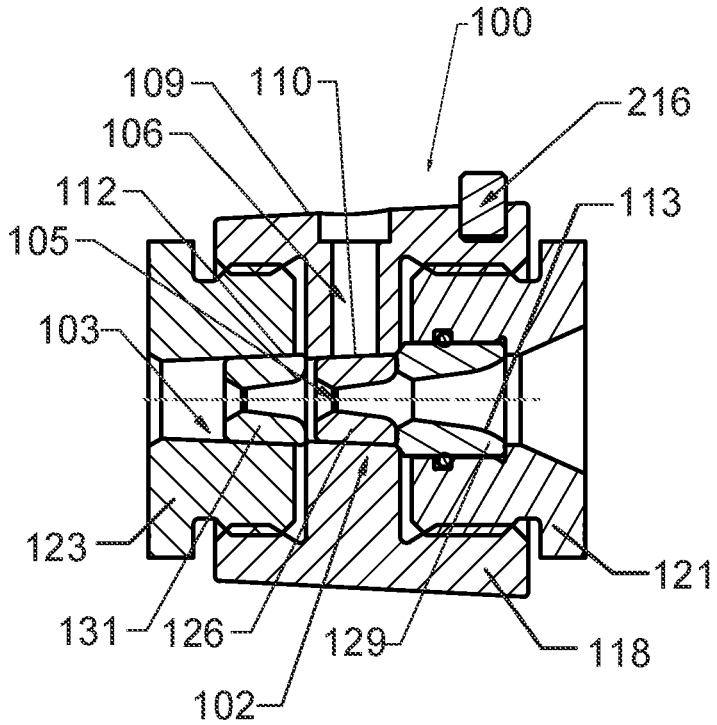
FIG. 3B shows a cross-sectional view of a die holder having a three piece die.
Figure 3C:
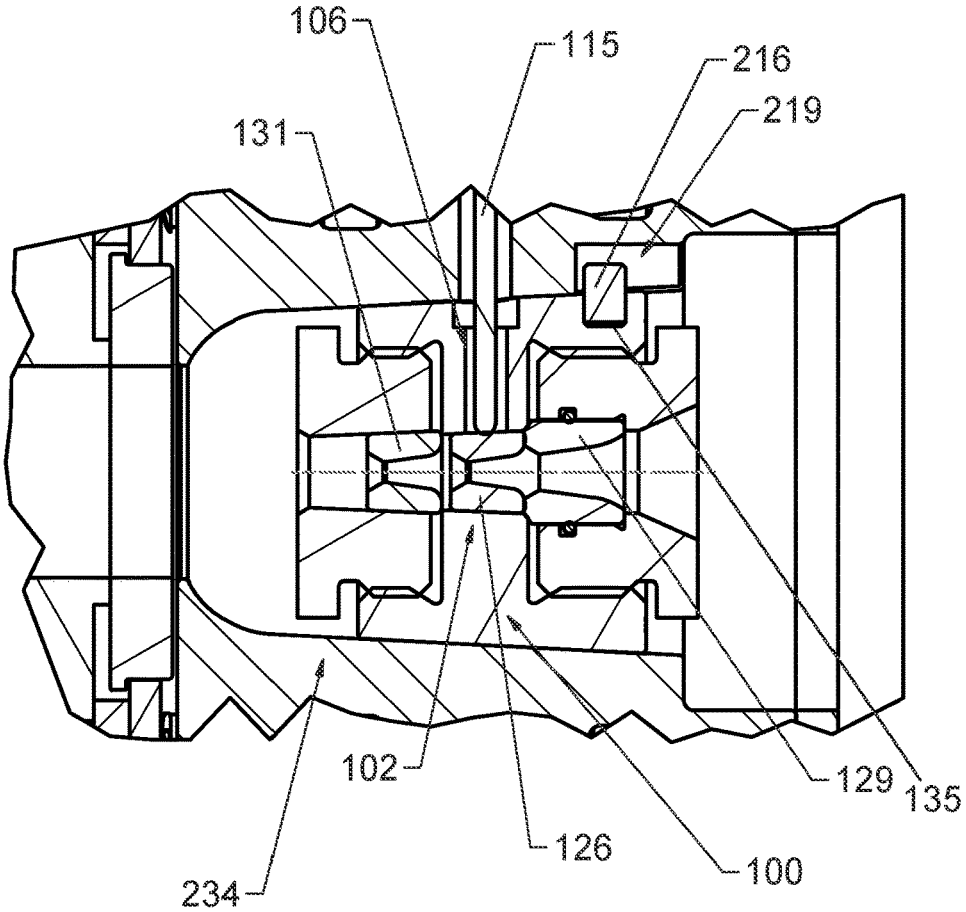
FIG. 3C shows a cross-sectional view of a die holder in a die box.

The die box 200 has a drawing die holder 100 that houses a die 102, as shown on FIGS. 2A, 2B and 2C. As known in the industry, the die 102 is made of a hard material such as tungsten carbide, polycrystalline diamond, natural diamond, or any other similar material. The die may also be referred to as a "nib" in certain applications. As shown in FIGS. 3A, 3B and 3C, the die 102 may be a single construction or several components, such as a pressure die 129 or nib, a drawing die 126, or a secondary die 131. FIG. 3A shows a drawing die holder 100 housing a two piece die 102, comprising a drawing die 126 and a pressure die 129 or nib. FIGS. 3B and 3C show a die holder housing a three piece die 102, comprising a drawing die 126, a pressure die 129, and a secondary die 131. FIG. 3C is an expanded view of a three piece die 102 in a die box 200. The drawing die holder 100 is configured to accept a probe 115 that measures one or more properties or physical characteristics of the die 102 used during a wire drawing process. The drawing die holder 100 has a drawing channel 103, which supports the die 102 during the wire drawing process. The drawing channel 103 extends longitudinally along the direction of travel of a wire during the drawing process. The drawing die holder 100 also has a die probe channel 106 that extends from a holder outer wall 109 to a holder inner wall 112 of the drawing die holder 100. As described herein, the drawing channel 103 is the boundary between the die outer wall 110 and the drawing die holder 100; the drawing channel 103 is the channel formed by the inner wall of the drawing die holder 100. The drawing channel 103 is different and runs parallel to the wire forming channel 105, which is the channel formed by the die inner wall 113.

In some embodiments, the die probe channel 106 is perpendicular or orthogonal to the drawing channel 103. It is contemplated, however, that in other embodiments that die probe channel 106 may have an orientation in relation to the drawing channel 103 that has a different angle, provided that the probe has access to the die 102. For example, if the drawing channel 103 is tapered, the probe channel 106, may extend vertically away from the drawing channel 106, without necessarily being perpendicularly or orthogonal to the drawing channel 106.

In some embodiments, the die 102 is cased within the drawing die holder 100. In other embodiments, the die 102 can be separated from the die holder 100. The drawing die holder 100, in some embodiments, can be divided into a first base 118 and a cap 121. The first base 118 holds a drawing die 126 that can be removed from the first base 118. In other embodiments, the drawing die 126 is encased within the first base 118 and is not removable or replaceable. The cap 121 of the drawing die holder 100 holds a pressure die 129 or nib that can be removed from the cap 121. In some embodiments the die holder 100 holds more than one pressure die 129. In other embodiments, the pressure die 129 is encased within the cap 121 and is not removable or replaceable. In a further embodiment, the drawing die holder 100 includes a second base 123. The second base 123 holds an secondary die 131 that is removable or replaceable. In other embodiments, the secondary die 131 is encased within the second base 123 and is not removable or replaceable. The secondary die 131 is an additional die that is used to impart specific properties to the wire, in addition to those imparted by the drawing die 126 and the pressure die 129. In some embodiments, the secondary die 131 has a small clearance to the drawn wire. The secondary die 131, in other embodiments, imparts a further diameter reduction of the wire. In other embodiments, the drawing die 131 may impart a small skin pass to harden the outer surface of the wire.

The die probe channel 106, in some embodiments, is within the first base 118. In embodiments where the drawing die 126 is permanently encased within the first base 118, which means that the drawing die 126 cannot be removed from the base 118; the die probe channel 106 extends to holder inner wall 112 of the drawing die holder 100, that is the portion of the first base 118 that encases the drawing die 126. On other embodiments, where the drawing die 126 is not encased, but is removable, from the first base 118; the die probe channel 126 extends to holder inner wall 112 of the drawing die holder 100, that is the portion of the first base 118 that comes in contact with the drawing die 126.

The die probe channel 106 houses a probe 115. In one embodiment, the probe 115 collects information from any portion of the die 102, whether the drawing die 126, the pressure die 129, or the secondary die 131. The probe 115 contacts the die 102, in some embodiments. The probe 115, in some embodiments, is a transducer that sends information to a sensor. The probe 115 in some embodiments is the transducer or information collector for one or more of a temperature sensor, a vibration sensor, a pressure sensor, an infrared sensor, a pyrometer, a magnetic field sensor, or any other type of sensor that that may collect physical characteristics from the die 102, the drawing die holder 100, or the wire that is being pulled through the drawing die holder 100. In some embodiments, where the sensor collects temperature information, the temperature sensor is a thermocouple or infrared sensor and the probe 115 is the portion of such sensor that collects and sends the temperature information to a data processing device 210. In some embodiments, the probe 115 physically contacts with the die 102. In other embodiments, the probe 115 has access to the die 102 through the die probe channel 106 and collects information from the die 102 without coming in direct contact with the die 102.

The probe 115, in some embodiments, is encased within the die probe channel 106, that is the probe 115 is fixed within the die probe channel 106 and is not allowed to slide in or out the die probe channel 106. In other embodiments, the probe 115 is removable from the die probe channel 106. In some embodiments, a retainer, such as a spring, provides pressure to the probe 115 against the die 102.

Figure 7A:
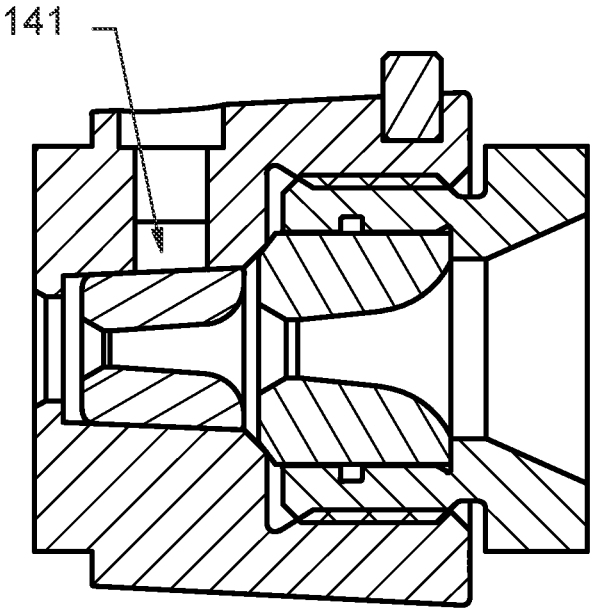
FIG. 7A and FIG. 7B are a cross-sections a drawing die holders having a filling material in the die probe channel.
Figure 7B:
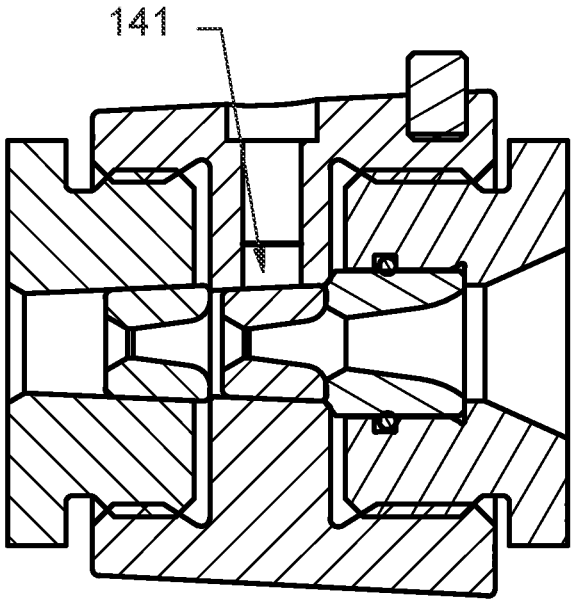

In other embodiments, as shown in FIGS. 7A and 7B, the die probe channel 106 contains conductive filling material 141. A conductive filling material 141 is one that easily carries a physical characteristic. In some embodiments, the conductive filling material 141 is thermally conductive to allow accurate reading of temperature of the die 102. The conductive filling material 141, in some embodiments, is at a bottom portion of the die probe channel 106 and contacts the die 102. The probe 115, in some embodiments contacts the conductive filling material 141, collecting information indirectly from the die 102. The probe 115, in some embodiments, is encased within the die probe channel 106, that is the probe 115 is in a fixed position within the die probe channel 106 and is not allowed to slide in or out the die probe channel 106 and contacts the conductive filling material 141. In other embodiments, the probe 115 is removable from the die probe channel 106. In some embodiments, a retainer, such as a spring, provides pressure to the probe 115 against the conductive filling material 141.

The probe 115, in some embodiments sends information from the die 102, the die holder 100, or other components to a data processing device 210. The data processing device 210, in some embodiments, is a reader, a transmitter, or a data logger. In some embodiments, the probe 115 is physically connected to the data processing device 210. In other embodiments, the probe 115 communicates wirelessly to the data processing device 210. Wireless communication reduces the possibility of physical connections being damaged during machine operations or when there is a wire drawing failure, in which loose wire under high tension that comes lose damage wired connections.

Figure 4A:
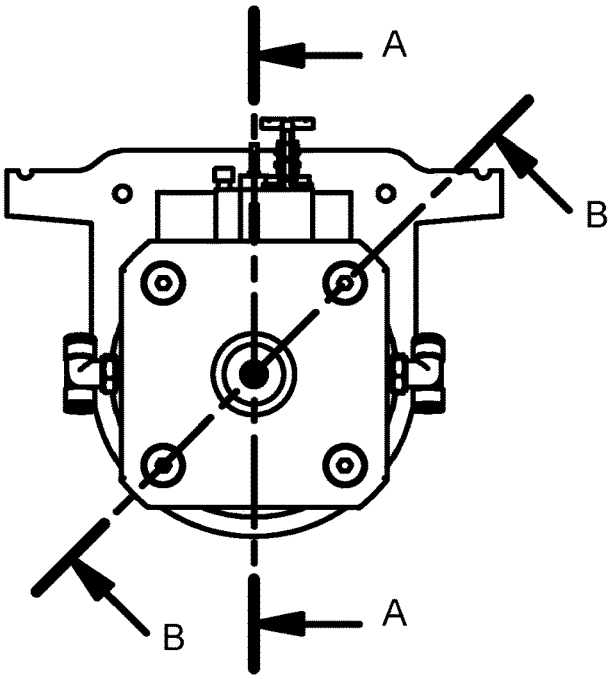
FIG. 4A is a front vie of a die box.
Figure 4B:
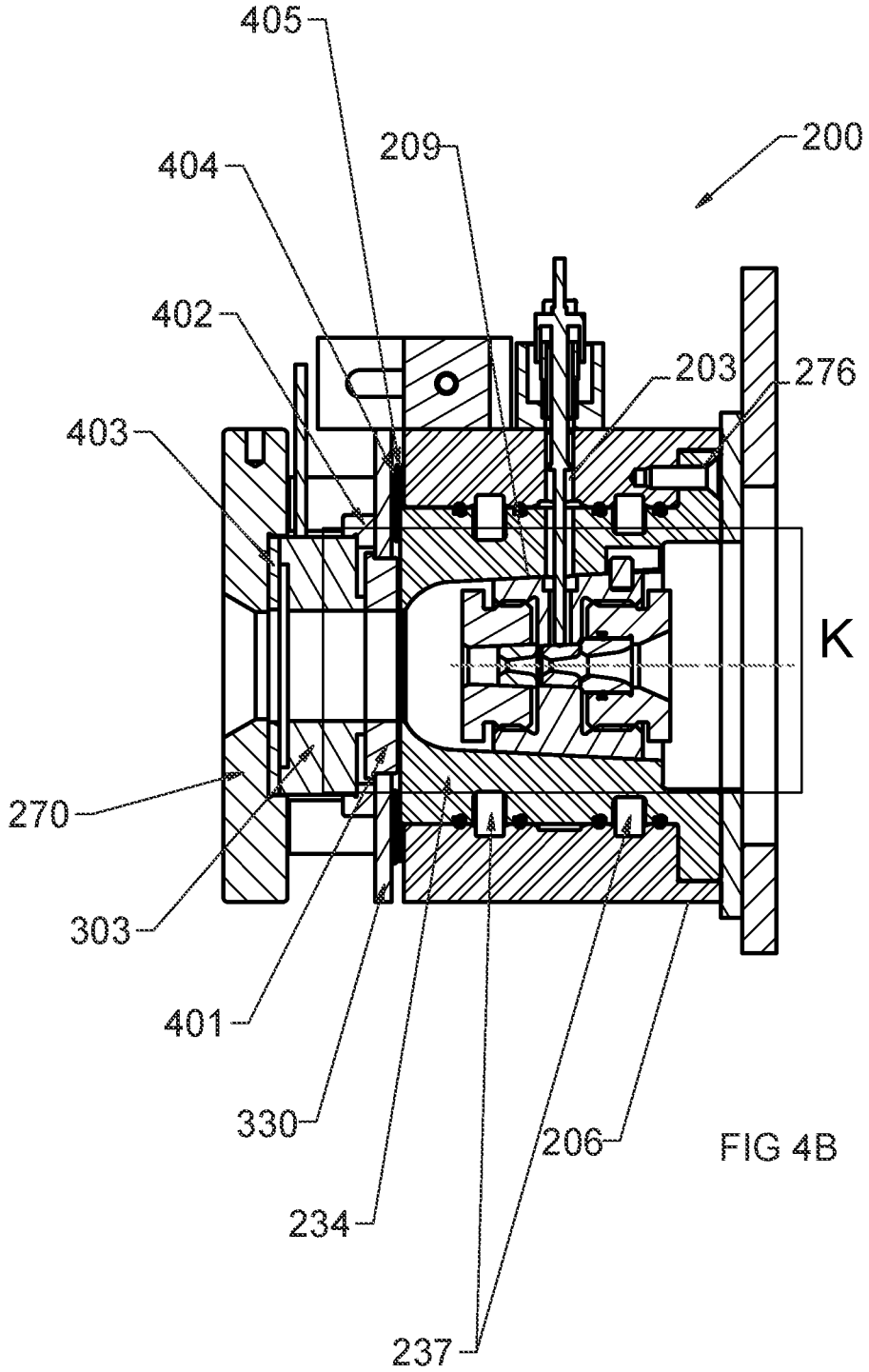
FIG. 4B is a cross section along axis AA of the die box.
Figure 4C:
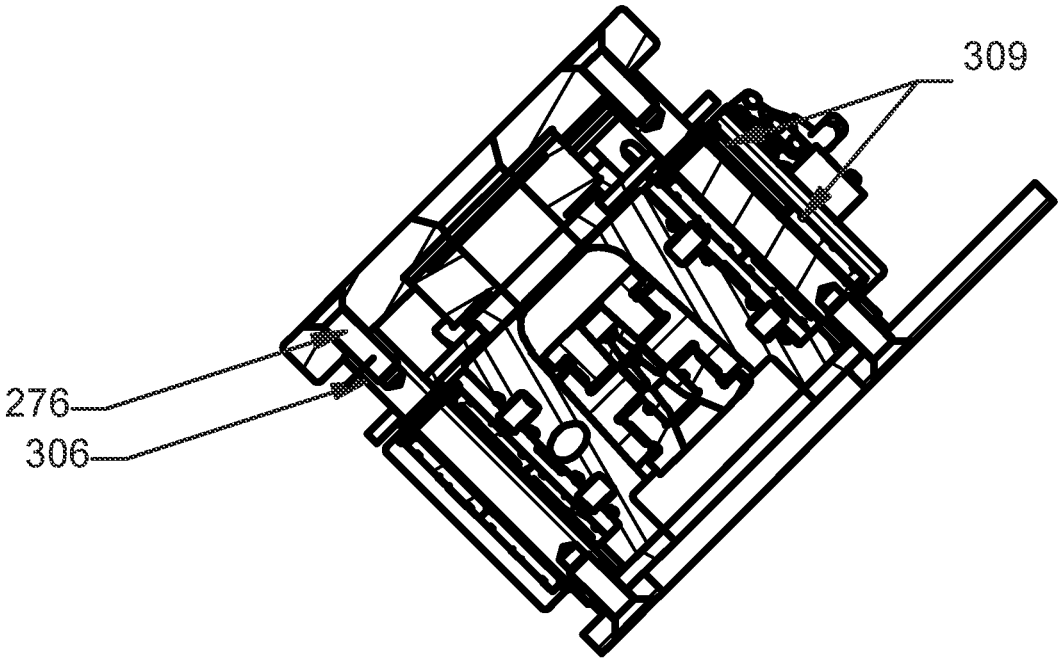
FIG. 4C is a cross section along axis BB of the die box.

In some embodiments, the drawing die holder 100 is housed within a die box 200, as shown in FIGS. 4A, 4B, and 4C. The die box 200 includes a box probe channel 203. The box probe channel 203 extends from the box outer wall 206 to the box inner wall 209, which is adjacent and runs parallel to the holder outer wall 109.

The box probe channel 203 houses the probe 115. In one embodiment, the probe 115 may collect information from any portion of the drawing die holder 100. In some embodiments, the probe 115 physically contacts with the die holder 100. In other embodiments, the probe 115 has access to the die holder 100 through the box probe channel 203 and collects information from the drawing die holder 100 without coming in direct contact with the drawing die holder 100. In further embodiments, the probe 115 extends through the die holder 100 and comes in contact with the die 102 and collects information from the die 102. In some embodiments, the probe 115 comes in contact with the drawing die 126. In further embodiments, the probe 115 extends through the die holder 100 but does not contact the die 102. The probe 115 collects information from the die 102 without direct contact with the die 102.

The probe 115, in some embodiments, is encased within the die box probe channel 203, that is the probe 115 is fixed within the box probe channel 203 and is not allowed to slide in or out the box probe channel 203. In other embodiments, the probe 115 is removable from the box probe channel 203. In some embodiments, a retainer, such as a spring, provides pressure to the probe 115 against the die holder 100.

In other embodiments, the die box probe channel 203 contains conducive filling material 141. The conductive filling material 141, in some embodiments, is at a bottom portion of the box probe channel 203 and contacts the die holder 100. The probe 115, in some embodiments contacts the conductive filling material 141, collecting information indirectly from the die holder 100. The probe 115, in some embodiments, is encased within the box probe channel 203, that is the probe 115 is fixed within the box probe channel 203 and is not allowed to slide in or out the box probe channel 203 and contacts the conductive filling material 141. In other embodiments, the probe 115 is removable from the box probe channel 203. In some embodiments, a retainer, such as a spring, provides pressure to the probe 115 against the conductive filling material 141.

In an exemplary embodiment, the die box 200 houses a die holder 100, that includes a die probe channel 106. The die box of claim 2B, wherein the box probe channel 203 and the die probe channel 106 are aligned; the probe 115 can then extend through both channels. In some embodiments, the die box 200 and the die holder 100 have an alignment element 213 that assist in properly aligning the die box probe channel 203 and the die probe channel 106. In some embodiments, the alignment is radial. The alignment element 213, for radial alignment, in some embodiments has two components: an alignment pin 216 and a recess 219 that matches the alignment pin 216. In some embodiments, the alignment pin 216 is part of the die box 200 and the recess 219 is in the die holder 100. In other embodiments, the alignment pin 216 is part of the die holder 100 and the recess 219 is part of the die box 200.

Figure 5A:
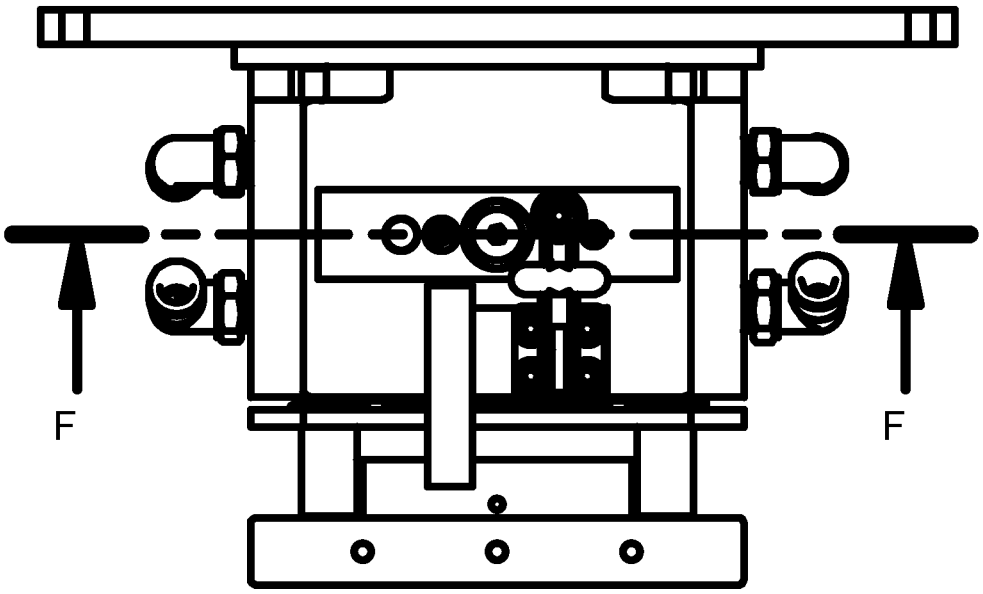
FIG. 5A is a top view of the die box.
Figure 5B:
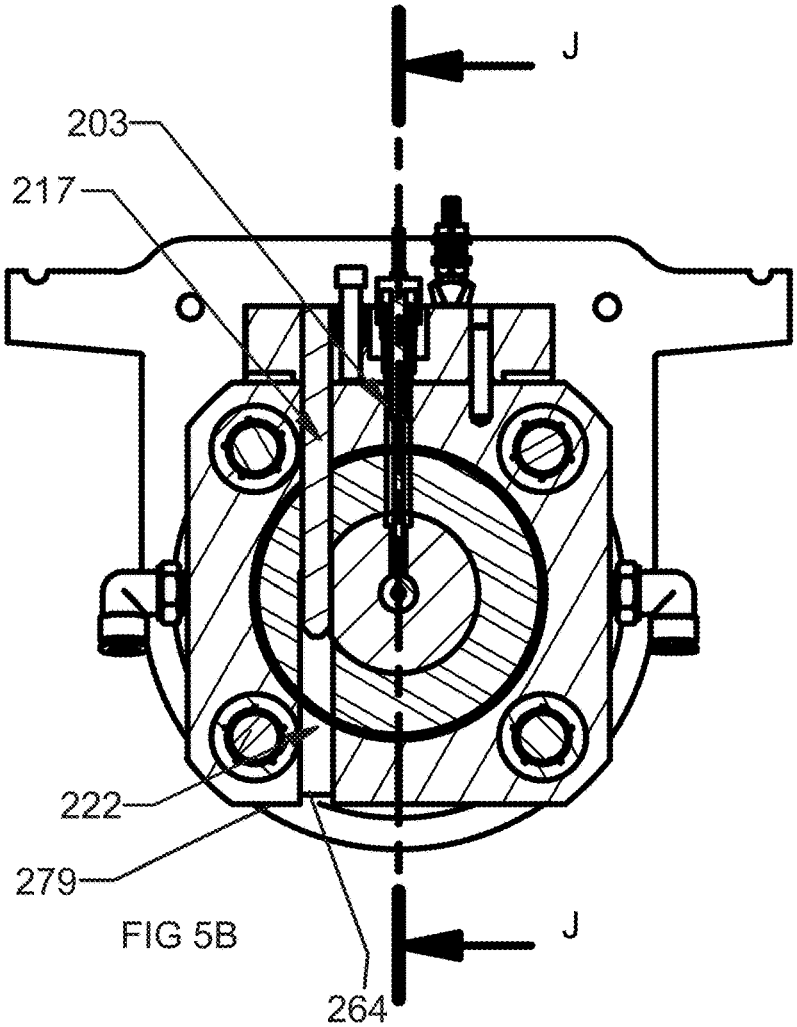
FIG. 5B is a cross-section along axis FF of the die box.
Figure 5C:
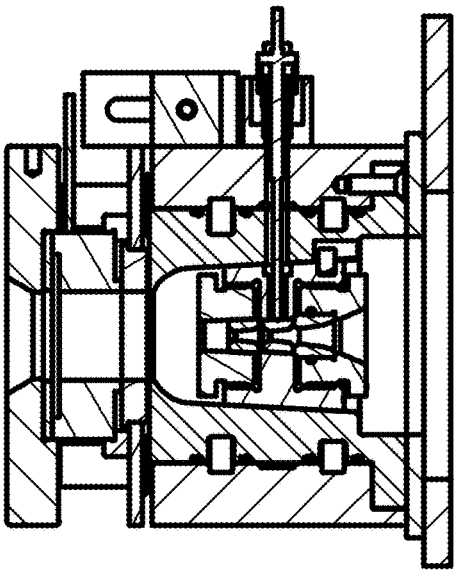
FIG. 5C is a cross-section along axis JJ of the die box.

As shown in FIG. 5B, the die box 200 has a die box alignment channel 222. The die box alignment channel 222 in some embodiments is parallel to the die box probe channel 203. The die box alignment channel 222 is also parallel to the die probe channel 106. In some embodiments, a first portion 225 of the alignment channel 222 is in the drawing die holder 100 and a second portion 228 of the die box alignment channel 222 is adjacent to the drawing die holder 100. The first portion 225 of the alignment channel 222 come together with the second portion 228 of the alignment channel 222 to form a single alignment channel that accommodates a locking pin 217. In some embodiments, the first portion 225 of the alignment channel has an oblong or irregular shape. In other embodiments, the oblong or irregular shape is on the second portion 228 of the die box alignment channel 222.

In some embodiments, the die box 200 has a jacket 234 for indirect cooling of the die holder 100. Indirect cooling, as discussed herein, refers to a type of cooling in which the die holder 100 is surrounded by the jacket 234, which comprises coolant channels through which the coolant flows removing heat from the jacket 234, which, in turn, removes heat from the die holder 100. The jacket 234 is a coolant jacket, in some embodiments, in some embodiments the coolant is water. The jacket 234 supports the die holder 100. The jacket 234 further provides a coolant channel 237, which provides, which provides indirect cooling to the die holder 100 and the die 102.

The die box 200, in some embodiments, includes a third portion of the box alignment channel 222 that extends through the jacket 234. The third portion 240 of the box alignment channel 222 is aligned with the first portion 225 and the second portion 228 of the box alignment channel 222. The locking pin 217, in some embodiments, extends through the first portion 225, the second portion 228, and the third portion 240 of the box alignment channel 222.

The die box 200 has a top side 243 that also has a displaceable safety block 246. The displaceable safety block 246 is pressed against the die box 200 by an "over center" latching type toggle clamp 252. In some embodiments, the displaceable safety block 246 of the die box 200 is located above the jacket 234, on the top side 243 of the die box 200. In some embodiments, the locking pin 217 is removably attached to the displaceable safety block 246. When the latching type toggle clamp 252 is actuated to the locked position the displaceable safety block 246 and the locking pin 217 are secured. When the latching type toggle clamp 252 is actuated to the unlocked position, the safety block 246 and locking pin 217 are free to be removed from the die box 246. In some instances, the locking pin 217 and/or safety block 246 may become stock and need to be removed from the die box 200. There are multiple displacement options in such instances.

The displaceable safety block 246, in some embodiment, has primary displacement device 249 for prying the safety block when it is stuck. The primary displacement device 255, in some embodiments is a flat channel 258 on a bottom side 261 of the displaceable safety block 246. The channel 258, in some embodiments extends through the displaceable safety block 246 from a first side to a second side. In other embodiments, the safety channel does not go through the entire length of the displaceable safety block 246, but consists of two slots, one on each side, milled into the displaceable safety block 246 to allow for a gap to pry the safety block 246 away from the top face of the die box 200. In other exemplary embodiments, a secondary displacement device 264 is used to further assist a user in removing the alignment locking pin 217 from the die box 200. In an exemplary embodiment, the secondary displacement device 264 is a screw that pushes against the jacket and separates the displaceable safety block from the die box 200 when the screw is turned. In yet a further embodiment, a terciary displacement device 249 includes a displacement channel 276 that extends from a die box bottom side 279 towards the box alignment channel 222 and has a diameter that is smaller than that of the alignment pin 216. A displacement pin (not shown) can be inserted through the displacement channel 276 to push the locking pin 217 out of the die box 200.

One embodiment, includes an slidable support 267, which can slide below the safety block to prevent it from falling while die 102 or die holder 100 are being removed.

In another embodiment, the die holder 100 is aligned within the die box 200 in an axial plane. Axial alignment in some embodiments is achieved through a die box drawing channel 105 that is tapered, which means that the diameter at one end of the drawing channel 105 is different than the diameter of the drawing channel 105 at second end.

In one exemplary embodiment, the die box 200 includes a force transducer 303. In some embodiments, the force transducer 303 is on a no-load state. In order to achieve a no-load state of the force transducer 303, the die box 200 has a guide rod 306 that allows the die box 200 to move along an axis that is parallel to the drawing channel 103. The die box 200, in other embodiments, includes a plurality of guide rods 306. The die box 200, may also have one or more linear bearings 309, or a plurality of linear bearings 309.

In one embodiment, where indirect cooling is used and the die box 200 includes a jacket 234 that is connected to a backplate 270. A force transfer plate 401 which connects to the force transducer 303. The force transducer 303 is retained up by the backplate 270 and the backplate 270 durability is enhanced by a hardened washer 403 that resides between the force transducer 303 and the backplate 270. The force transducer 303 is held in place by a retaining ring 402. The retaining ring 402 applies pressure to the outer ring of the force transducer 303 and spring pressure is supplied by wavy washers 404 retained by retaining clips 405. This configuration secures the force transducer 303 in a non pre load state. The sliding plate 330 ensures radial alignment of the force transfer plate 401 yet allowing linear movement to compress the force transducer as required by the jacket 234 during wire drawing.

The jacket 234 is connected to the backplate 270 by one or more guide rods 306 or a plurality of guide rods 306. In another embodiment, the die box 200 has a sliding plate 330 between the jacket 234 and the backplate 270. A force transducer 303 is placed between the sliding plate 330 and the backplate 270. In other embodiments, a force transfer plate 330 is placed between the force transducer 303 and the jacket 234.

Figure 8:
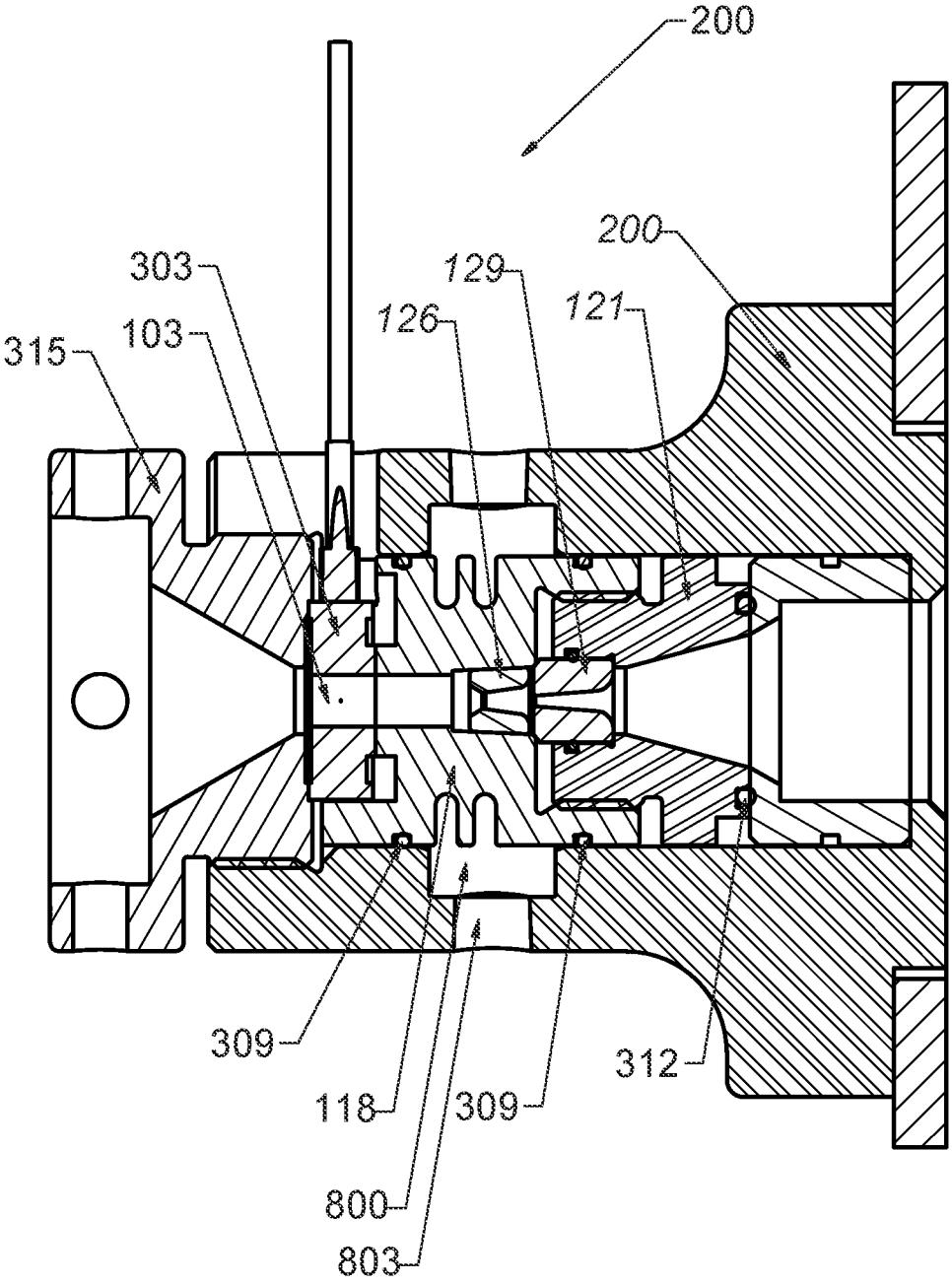
FIG. 8 is a cross-section of a die box that is subject to direct cooling.
Figure 9:
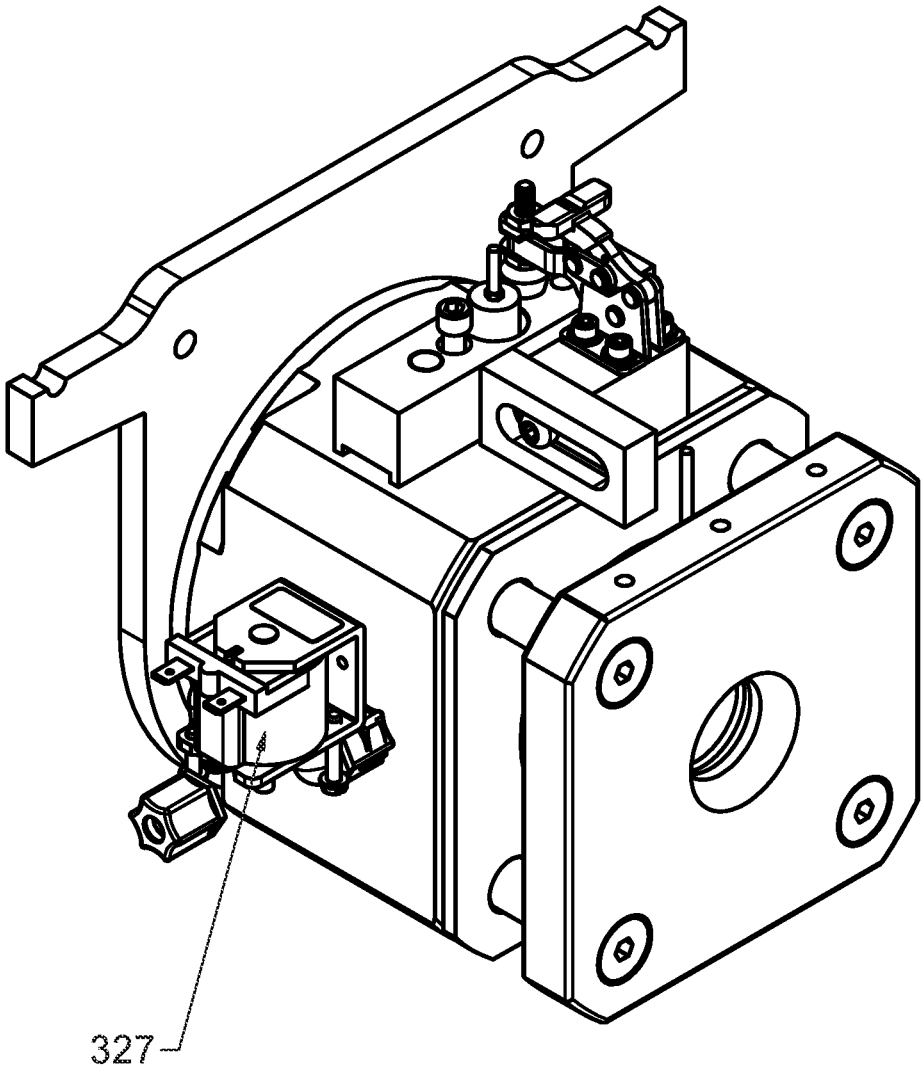
FIG. 9 is a perspective view of a die box with a coolant flow regulator.

The die box 200 provides direct cooling in some embodiments. A direct cooling embodiment is shown in FIG. 8. As discussed herein, direct cooling refers to coolant being able to access the die holder 100. In order to provide direct cooling, the die box 200 includes a die holder o-ring 309 and a die box o-ring 312, which allow direct cooling of the die holder 100. A coolant intake 803 delivers coolant to the cooling channel 800 that has direct contact with the drawing die holder 100. As discussed above, the die holder 100 within the die box 200, can be cooled directly or indirectly. In either type of cooling, the die box is connected to a coolant flow regulator 327, as shown in FIG. 9. The coolant flow regulator 327 changes the rate of coolant being pushed through the system to cool the holder 126 to a specific temperature. Information from various sensors described herein is utilized to adjust the flow regulator 327 output.

The die box 200, in some embodiments, includes a die box nut 315, which restricts movement of the die holder 100 along an axis that is parallel to the drawing channel 103. In some embodiments, the installation of the die box nut 315 is configured to avoid axial pre-loading upon installation. In direct cooling applications, the die box nut 315 can only penetrate the die box 200 to a predetermined position that prevents loading of the force transducer 303, by giving the drawing die holder space to move. In such embodiments, the drawing die holder 100 is allowed to move along the wire drawing axis. The drawing die holder 100 is only allowed to travel sufficiently to avoid pre loading, i.e, pressure when the wire is not being drawn, the force transducer.

The die box 200 in some embodiments includes any of the following sensors: a vibration sensor 318, a magnetic sensor 321, hall effect sensor 324, and any other sensors. It is contemplated that the die box 200, in some embodiments, includes a rotating die holder. A rotating die holder, is one that is allowed to rotate as the wire is being drawn. Rotating die holders include sensors that deliver information collected from the die holder wirelessly to the control unit.

The die box 200 and the die holder 100 are part of a drawing system that includes two or more probes that measure two or more physical properties of the die box 200, the die holder 100, the die 102, and other components of a wire drawing system, at least one of the probes measures properties at a die surface that is parallel to a die holder surface, and a control unit. As used herein, the term "physical property" refers to a measurable quality of the die box 200, die holder 100, die 120, or wire. Such "physical properties" may be quasi-permanent to the materials from which the components of the die box 200, drawing die holder 100, die 102, and wire are made, such as temperature, conductivity, and so on. Other "physical properties", as used herein, refer to measurable qualities that change based the wire drawing process. For example, the temperature of the die holder 100 or die 102, vibrations at the die box 200, and other similar qualities. The two or more probes send information to the control unit. The control unit can then send the information to a graphical user interface for the user to evaluate or for a program that manages the machine's parameters to take a specific action. In some embodiments, the control unit processes the information and makes automatic adjustments to specified wire drawing parameters. For example, the control unit in some embodiments, combines the information gathered from the various probes and automatically adjusts the drawing speed of the process, the flow of coolant supplied to the die box, and other similar parameters. In some embodiments, the control unit controls the flow of coolant supplied by a coolant flow regulator at the die box. One advantage of the system described herein is that the probes send information to the control unit or data processing device 210 in "real time", that is while the wire is being drawn through the machine in order to be able to make adjustments to the wire drawing process without having to stop the system In some embodiments, a system comprises a plurality of die boxes 200 with a plurality of probes and sensors that send information to a single control unit, which, in turn, adjust the wire drawing machine's parameters. The system regulates the machine's parameters based on the information gathered from the probes 115 at the die box 200 and the drawing die holder 100. The system plurality of die boxes 200, in some embodiments, are within a single wire drawing machine. In some embodiments, the plurality of die boxes 200 may be in multiple wire drawing machines that are running simultaneously. The control unit is designed to change the various parameters in different machines based on real time readings of each die box 200.

A wire drawing monitoring system that has a wire drawing box comprising two or more probes that measure two or more properties of a wire drawing device. As described above, one of said two or more properties are measured at a die surface that is parallel to a die holder surface. The system also has a control unit and the two or more probes send information to the control unit. The wire drawing system also includes a drawing die holder. The wire drawing system has a control unit that is configured to receive and process the information from the two or more probes. The wire drawing system, in some embodiments, includes two or more wire drawing boxes.

The system implements a method of controlling a wire drawing machine's parameters based on information collected from probes at the die box 200 and drawing die holder 100 as described above. In a first step of the method, a wire drawing machine that has a probes and sensors on one or more die boxes 200 and drawing die holders 100 initiates a wire drawing through the drawing die holder 100. In a second step, information is collected from the probes 115 at the die holder 100 and die box 200. In some embodiments, the probe 115 is within a die holder 100. The probe 115 contacts the die 102, other probes or sensors collect additional information directly from the die box 200 and drawing die holder 100. In a third step, the information is sent to a data processing device 210. The data processing device 210, comprises a processing unit or computer that is programmed to collect and process the data received from the various probes. In a further step, the information collected is processed. In yet a further step, the data processing device 210 controls various parameters of the drawing machine at the die box 200 or die holder 100.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

INDUSTRIAL APPLICABILITY

The present invention is directed to manufacturing metal wires by drawing machines. More specifically to dies and die holders and monitoring systems for such manufacturing and it is used in the industry.

What is claimed is:

1. A die box, comprising:

two or more probes that measure various characteristics of components of the die box or a wire being drawn through the die box and at least one probe channel for at least one of said two or more probes;

a drawing die holder comprising a die probe channel, wherein the die probe channel is aligned with the at least one probe channel;

wherein one of the at least two or more probes is a force transducer;

at least one of a plurality of guide rods or a plurality of linear bearings; which allow the die box to slide along an axis parallel to the drawing channel, which allows the force transducer to achieve a load or no-load state.

2. The die box of claim 1, wherein the die probe channel extends from an outer wall to an inner wall of the drawing die holder.

3. The die box of claim 2, wherein the die probe channel is perpendicular to the drawing channel.

4. The die box of claim 2, wherein the drawing die holder further comprises at least one of a first base, a cap, and a die.

5. The die box of claim 4, wherein the die is one or more of a pressure die, a drawing die, and a secondary die.

6. The die box of claim 4, wherein the die probe channel is located within the first base.

7. The die box of claim 6, further comprising a probe housed within the die probe channel, wherein the probe is one or more of a temperature sensor, a vibration sensor, a pressure sensor, an infrared sensor, a pyrometer, a magnetic field sensor, and a magnetic or hall effect sensor.

8. The die box of claim 7, wherein the probe is in contact with the die.

9. The die box of claim 8, further comprising a spring providing pressure to the probe against the die.

10. The die box of claim 7, wherein the probe is configured to send the information that the probe collects to a data processing device; which is one or more of a reader, a transmitter, or a data logger.

11. The die box of claim 1, wherein the die box and the drawing die holder form a single structure.

12. The die box of claim 1, wherein the drawing die holder has a drawing channel that is tapered.

13. The die box of claim 1, wherein the die probe channel extends from an outer wall of the die box to an inner wall of the die box.

14. The die box of claim 1, wherein the force transducer is on a no-load state.

15. The die box of claim 1, further comprising a jacket for indirect cooling of the drawing die holder.

16. The die box of claim 15, configured such that a force of a wire being drawn through the die is transferred from the drawing die holder to the jacket then to a transfer plate then to the force transducer, wherein stationary backing support is supplied by a hardened washer and a backplate.

17. The die box of claim 15, wherein the jacket comprises a water channel.

18. The die box of claim 17, further comprising a coolant flow regulator.

19. The die box of claim 1, wherein the drawing die holder is subject to direct cooling.

20. The die box of claim 19, further comprising a die holder o-ring and a die box o-ring, which allow direct cooling of the drawing die holder.

21. The die box of claim 1, further comprising a die box nut, wherein the die box nut allows movement of the drawing die holder along an axis that is parallel to a drawing channel in the drawing die holder.

22. The die box of claim 17, wherein a transfer plate is radially aligned with a sliding plate.

23. A wire drawing monitoring system, comprising:

a die box of claim 1, and a control unit, wherein the two or more probes send information to the control unit.

24. The wire drawing monitoring system of claim 23, wherein the control unit is configured to receive and process the information from the two or more probes.

25. The wire drawing monitoring system of claim 24, further comprising one or more wire drawing boxes.

* * * * *